US006715184B1

(12) United States Patent
Droschak

(10) Patent No.: US 6,715,184 B1
(45) Date of Patent: Apr. 6, 2004

(54) BOUTONNIERE BUTTONEER APPARATUS

(76) Inventor: Patricia Droschak, 705 Merlin Dr., Schaumburg, IL (US) 60193

( * ) Notice: Subject to any disclaimer, the term of this patent is extended or adjusted under 35 U.S.C. 154(b) by 0 days.

(21) Appl. No.: 10/375,640

(22) Filed: Feb. 28, 2003

(51) Int. Cl.[7] ..... A45F 5/08
(52) U.S. Cl. ..... 24/5; 24/13
(58) Field of Search ..... 24/3.1, 5, 13; 40/1.5; 2/244; 63/1.18, 36

(56) References Cited

U.S. PATENT DOCUMENTS

| | | | | | |
|---|---|---|---|---|---|
| 1,177,523 | A | | 3/1916 | Kampelman | |
| 1,359,381 | A | | 11/1920 | Hornbeck | |
| 1,552,156 | A | * | 9/1925 | Heller | 24/3.13 |
| 2,721,410 | A | | 10/1955 | Davis | |
| 3,088,295 | A | * | 5/1963 | Haines | 63/20 |
| 3,735,447 | A | * | 5/1973 | Abraham | 24/6 |
| 3,982,303 | A | | 9/1976 | Shulkin | |
| 4,961,275 | A | * | 10/1990 | Klein | 40/1.5 |
| D334,905 | S | | 4/1993 | Ritz | |
| 5,836,017 | A | | 11/1998 | Hironaga et al. | |
| 6,122,805 | A | * | 9/2000 | Haegley | 24/114.4 |
| 6,279,202 | B1 | * | 8/2001 | Wojdylak et al. | 24/12 |
| 6,389,649 | B1 | * | 5/2002 | Metzler | 24/6 |

* cited by examiner

*Primary Examiner*—Robert J. Sandy
(74) *Attorney, Agent, or Firm*—Zachary Hamilton

(57) ABSTRACT

A boutonniere buttoneer, having a rectangular body, a front side and a back side, and having two cylindrical legs connected to the back side which are substantially close to the ends respectively; and having leg covers having a hole and handle for receiving the legs; where when legs penetrate a fabric the leg covers clamp onto the legs and prevent said rectangular body from moving.

28 Claims, 2 Drawing Sheets

BOUTONNIERE BUTTONEER APPARATUS

BACKGROUND OF THE INVENTION

The present invention relates a boutonniere buttoneer. More specifically, the present invention relates to an improved affixing of a boutonniere to clothing.

DISCUSSION OF RELATED ART

It has been, for at least many decades, conventional to use long straight pins for mounting corsages onto dresses, etc. This has occasionally given rise to "jokes" about the stabbing by the pins—especially during the mounting procedure—of women wearing the dresses. However, the matter is, in fact, not at all funny. Not only can painful injury occur, but even in the best of circumstances, the corsage is not mounted as safely or easily or stably as desired.

Over at least several decades, attempts have been made to achieve replacements for the conventional long straight corsage-mounting pins. The resulting devices are not known by the present inventor to have achieved commercial success. Hironaga et al. (U.S. Pat. No. 5,836,017) discloses a corsage assembly and combination thereof with clothing. The corsage assembly uses a small wire element having two ends. However, re-use of the device becomes may lead to the wire breaking due to repeated bending and because it is a wire it is easy to lose sight of and easily misplaced. It is from a practical commercial standpoint of massive importance that the devices on which the corsages are mounted by florists not only be practical and satisfactory but very cheap, safe and reusable.

SUMMARY OF THE INVENTION

An aspect of the present invention regards a boutonniere buttoneer, having a rectangular body, a front side and a back side, the boutonniere buttoneer has two cylindrical legs connected to the back side which are substantially close to the ends respectively. The boutonniere buttoneer has leg covers comprising a hole and handle for receiving the legs; where when legs penetrate a fabric the leg covers clamp onto the legs and prevent said rectangular body from moving.

The aspect of the above-mentioned present invention presents the advantages of safety to a person wearing the boutonniere buttoneer and to a person affixing the boutonniere buttoner. The present invention, also, will not damage a corsage attached to the boutonniere buttoner. The present invention is sturdy, easily bendable and re-bendable without breaking, very cheap and reusable.

DETAILED DESCRIPTION OF THE INVENTION

Figure 1:
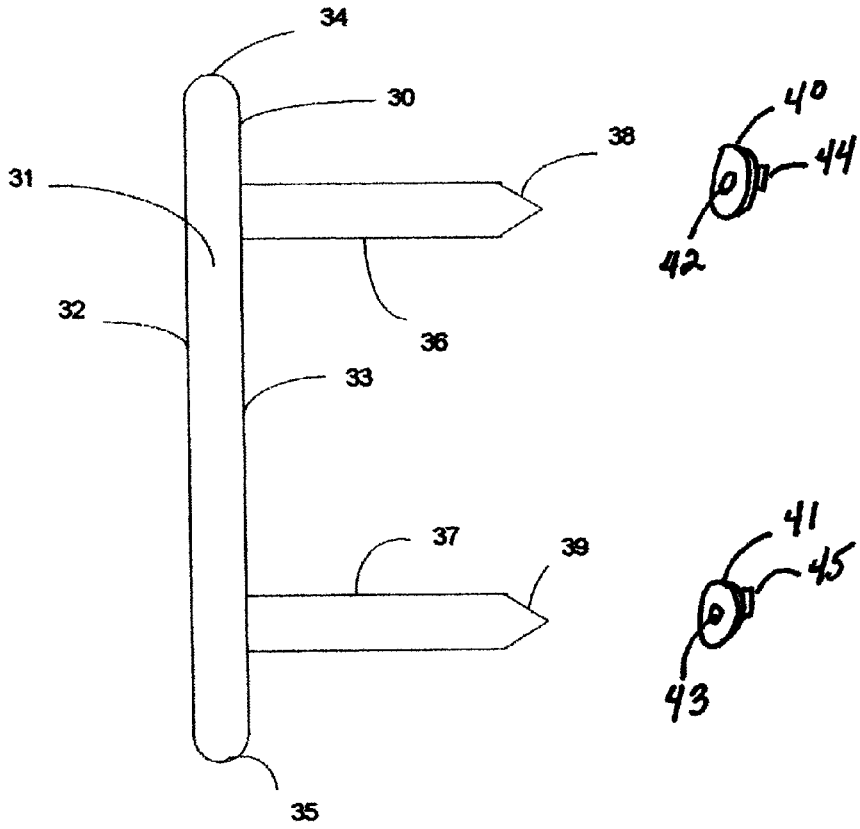
FIG. 1 is a side view of the boutonniere buttoneer according to an embodiment of the present invention.

FIG. 1 shows a side view of a boutonniere buttoneer 30. The boutonniere buttoneer 30 comprises a rectangular body 31 having a front side 32, a back side 33, a first end 34 and second end 35. The rectangular body 31 provides a sturdy base for the boutonniere buttoneer 30. The boutonniere buttoneer 30 further comprises legs 36, 37 connected to the back side 34 and transverse to the rectangular body 31. Legs 36, 37 each have a pointed remote end 38, 39 respectively. The pointed remote ends 38, 39 allow easy penetration of a fabric without causing permanent damage to the fabric. Leg 36 is connected substantially close to the first end 34 of the rectangular body 31. Leg 37 is connected substantially close to the second end 35. Thus, the legs 36, 37 are hidden when the boutonniere buttoneer 30 is used. The boutonniere buttoneer 30 further comprises two leg covers 40, 41. The leg covers 40, 41 each has a hole 42, 43 and handle 44, 45 respectively for receiving the legs 36, 37 respectively. Thus, when legs 36, 37 penetrate a fabric the leg covers 40, 41 prevent the rectangular body 31 from moving. The leg covers 40,41 safely keeps the wearer from being stuck by the pointed remote ends 38, 39.

Figure 2:
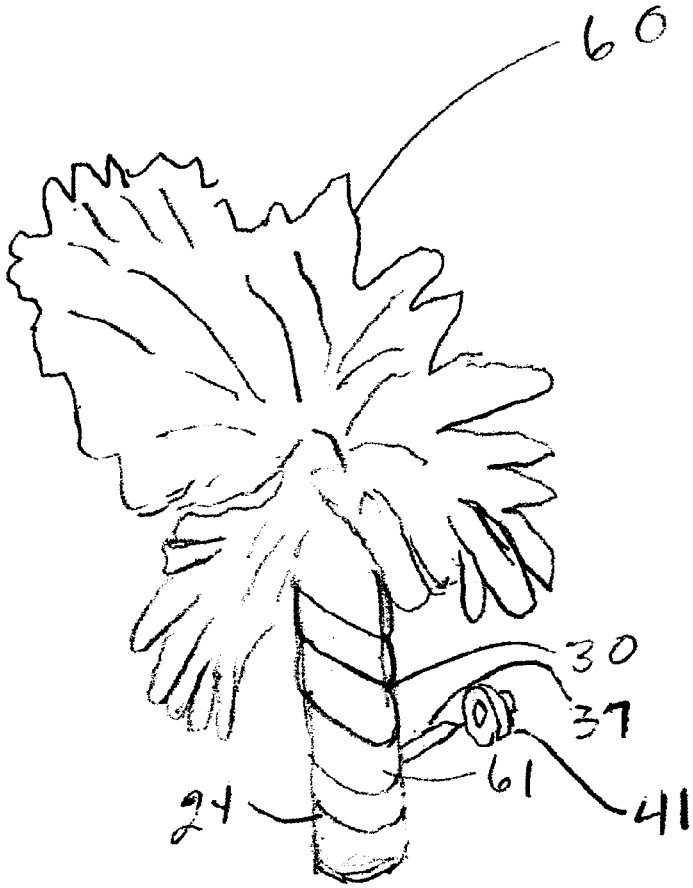
FIG. 2 shows a perspective view of boutonniere buttoneer with corsage according to an embodiment of the present invention.

FIG. 2 shows an perspective view of a corsage 60 with the boutonniere buttoneer 30 wrapped in floral tape 61, leg 37 and leg cover 41. In use, the corsage 60 is placed on the front side 32 of the boutonniere buttoneer 30. Floral tape 61 is wrapped entirely around a stem (not shown) of the corsage 60 and the boutonniere buttoneer 30 leaving the legs 36 (not shown), 37 exposed. The boutonniere buttoneer 30 is placed on a recipient by poking the pointed remote ends 38, 39 of the legs 36, 37 through a fabric, such as a lapel, dress or arm band, and clamping the leg covers 40, 41 to remote ends 38, 39 respectively thereby preventing the rectangular body 31 from moving. Additional details of the boutonniere buttoneer 30 will now be discussed.

Referring again to FIG. 1, the length of rectangular body 31 is typically 2 inches with a width of ½ inch and thickness of ⅛ inch or less and is made of a bendable metal or plastic. However, the length of rectangular body 31 may be greater than or less than 2 inches depending on the boutonniere buttoneer's 30 use. For example, a large man will typically have a large lapel on a suit he wears and therefore require a longer rectangular body 31. Conversely, a small man will typically have a smaller lapel on a suit he wears and require a shorter rectangular body 31. The ends 34, 35 are typically rounded. This prevents the boutonniere buttoneer 30 from snagging or cutting a person's fabric, the person or a person affixing the boutonniere buttoneer 30 to the fabric. Preferably, the front side 32 and back side 33 of the boutonniere buttoneer 30 are planar.

As shown in FIG. 1, legs 36, 37 are attached to the back side 33 of the rectangular body 31. The legs 36, 37 extend outwardly from and transverse the rectangular body 31. Each leg 36, 37 has a remote end 38, 39.

In a preferred embodiment, the remote ends 38, 39 are pointed for easy penetration of a fabric without causing permanent damage to the fabric. Preferably the legs 36, 37 are integrally connected to the back side 33 of the rectangular body 31 to prevent the legs 36, 37 from breaking off during use. However, the legs 36, 37 may be connected to the rectangular body 31 by using an adhesive or other method known in the art Preferably, the legs 36, 37 extend less than ½ inch from the back side 33 of the rectangular body 31.

The remaining component of the boutonniere buttoneer 30 is the leg cover 40, 41. These are small, preferably having a diameter of 5⁄16 inch, and large numbers thereof are easily stored in a box. All are, preferably, identical for all uses.

Each leg cover 40, 41 is a disc having a planar face adapted to engage the fabric. On the side of the disc remote from such planar face is a handle portion 44, 45 having flat parallel sides adapted to be held (by compression) between two fingers of a person mounting the boutonniere buttoneer 30 on a dress, suit lapel or arm band.

A central hole 42, 43 is provided in each button 40, 41. Such hole is a blind "passage" extending toward and into the handle 44, 45 from the planar side face of leg cover 40, 41.

The leg cover 40, 41 and handles 44, 45 are integral with each other, and are preferably composed of somewhat soft, flexible synthetic resin. However, they may be composed of metal. Hole 42, 43 has a diameter about equal or somewhat smaller than the leg diameter. Accordingly, and because the synthetic resin is not so soft that it does not have significant hoop strength around the legs, the buttons "clamp" and cling to the legs 36, 37, holding the boutonniere buttoneer 30 in mounted condition on the fabric. In no realistic event can a leg 36, 37 penetrate all the way through a combination leg cover/handle 40, 41/44, 45 when the boutonniere buttoneer 30 is mounted on a typical dress, lapel or arm band. Accordingly, the person will not be contacted by the pointed remote ends 38, 39. Such a leg cover 40, 41 may be obtained from Custom Signs & Name Badges, 879 Castle Kirk Drive, Baton Rouge, La. 70808 and are known as "Military Post Fasteners".

When the florist receives an order for a particular corsage, he or she selects the size of the boutonniere buttoneer 30 that is appropriate to the particular flowers, size of person and article it is to be worn on. Then, the front side 32 of the boutonniere buttoneer 30 is disposed parallel to and adjacent the stems of the flowers without damaging the flowers or their petals.

As shown in FIG. 2, the stems and the petals of the flowers 60 are disposed on the front side 32 of the boutonniere buttoneer 30 that is remote from the legs 36, 37.

The floral tape 61 is wrapped around the boutonniere buttoneer 30 preferably in helical manner to form the helix 24 as shown in FIG. 2. The tape is of any color desired and paper-like, with an interior tacky surface, and cooperates with the rectangular body 31 to hold the flowers 60 firmly in place. Such tape may be obtained from CK Products, 310 Racquet Dr., Fort Wayne, Ind.

The florist then takes two leg covers 40, 41 from their box, and mounts them on legs 36, 37, completing the assembly of the boutonniere buttoneer 30. From that time on, and when the boutonniere buttoneer 30 is handed to a person who will wear it, the pointed remote ends 38, 39 are covered by the leg covers 40, 41 so that the person is protected from injury.

When the person is ready to wear the boutonniere buttoneer 30, he or she removes the two leg covers 40, 41 and inserts the pointed remote ends 38, 39 and legs 36, 37 inwardly through the fabric. This the person does by holding the fabric away from his or her skin with one hand, while inserting the legs 36, 37 with the other. He or she immediately replaces the leg covers 40, 41 on the legs 36, 37 but on the inside of her dress, lapel or wrist band. The person pushes the leg covers outwardly until the inside surface of the fabric is contacted.

Thus, the present boutonniere buttoneer 30 is not only combined with flowers 60 and tape 61 to form the boutonniere buttoneer 30, but also combined with different types of fabrics.

There is safety because legs 36, 37 are short and are covered. There is stability because flatness of the rectangular body 31. The leg covers 40, 41 firmly grip the legs 36, 37 to keep the boutonniere buttoneer 30 assembly from coming off. There is ease of mounting because pushing the short legs 36, 37 through the fabric, and mounting the leg covers 40, 41, is much easier than inserting a long straight pin in the conventional manner.

The foregoing description is provided to illustrate the invention, and is not to be construed as a limitation. Numerous additions, substitutions and other changes can be made to the invention without departing from its scope as set forth in the appended claims.

What is claimed is:

1. A boutonniere buttoneer, comprising:

a rectangular body comprising a front side and a back side;

a boutonniere disposed adjacent and parallel to said front side of said rectangular body;

a leg connected to said back side of said rectangular body;

said leg extending from said back side of said rectangular body and having a remote end; and a leg cover comprising a hole and handles for receiving said remote end;

wherein when said leg penetrates a fabric, and said leg cover prevents said rectangular body from moving.

2. The boutonniere buttneer as claimed in claim 1, wherein said rectangular body has rounded corners.

3. The boutonniere buttoneer as claimed in claim 1, wherein said rectangular body is ½ inch wide.

4. The boutonniere buttoneer as claimed in claim 1, wherein said rectangular body is 2 inches in length.

5. The boutonniere buttoneer as claimed in claim 1, wherein said rectangular body is less than ⅛ inch thick.

6. The boutonniere buttoneer as claimed in claim 1, wherein said rectangular body comprises a metal rectangular body.

7. The boutonniere buttoneer as claimed in claim 1, wherein said rectangular body comprises a plastic rectangular body.

8. The boutonniere buttoneer as claimed in claim 1, wherein said front side is planar.

9. The boutonniere buttoneer as claimed in claim 1, wherein said back side is planar.

10. The boutonniere buttoneer as claimed in claim 1, wherein said boutonniere is disposed on said front of said rectangular body by wrapping a stem of said boutonniere and said rectangular body with floral tape.

11. The boutonniere buttoneer as claimed in claim 1, wherein said leg is integrally connected to said back side of said rectangular body.

12. The boutonniere buttoneer as claimed in claim 1, wherein said leg is cylindrical.

13. The boutonniere buttoneer as claimed in claim 1, wherein said remote end of said leg is pointed.

14. The boutonniere buttoneer as claimed in claim 1, wherein said leg extends less than ½ inch from said back side of said rectangular body.

15. The boutonniere buttoneer as claimed in claim 14, wherein the leg is a first leg, and further comprising a second leg.

16. The boutonniere buttoneer as claimed in claim 15, wherein said first leg is connected substantially close to a first end of said back side of said rectangular body and said second leg is connected substantially close to a second end of said back side of said rectangular body.

17. The boutonniere buttoneer as claimed in claim 13, wherein said first leg and said second leg transverse said rectangular body.

18. A boutonniere buttoneer, comprising:

a rectangular body comprising a front side, a back side, a first end and a second end;

a first leg connected to said back side and substantially close to said first end of said rectangular body and comprising a first remote end;

a second leg connected to said back side and substantially close to said second end of said rectangular body and comprising a second remote end;

said first and second legs extending from said back side of said rectangular body and transverse to said rectangular body;

said first and second legs are cylindrical; and leg covers comprising a hole and handles for receiving said first and second remote ends;

wherein when said first and second legs penetrate a fabric, and said leg covers clamp on said first and second remote ends and prevent said rectangular body from moving.

19. The boutonniere buttoneer as claimed in claim 18, wherein said rectangular body comprises rounded corners.

20. The boutonniere buttoneer as claimed in claim 18, wherein said rectangular body is ½ inch wide.

21. The boutonniere buttoneer as claimed in claim 18, wherein said rectangular body is less than 3 inches in length.

22. The boutonniere buttoneer as claimed in claim 18, wherein said rectangular body is less than ⅛ inch thick.

23. The boutonniere buttoneer as claimed in claim 18, wherein said rectangular body comprises a metal rectangular body.

24. The boutonniere buttoneer as claimed in claim 18, wherein said rectangular body comprises a plastic rectangular body.

25. The boutonniere buttoneer as claimed in claim 18, wherein said boutonniere is disposed on said front of said rectangular body by wrapping a stem of said boutonniere and said rectangular body with floral tape.

26. The boutonniere buttoneer as claimed in claim 18, wherein said first leg and second leg are integrally connected to said back side of said rectangular body.

27. The boutonniere buttoneer as claimed in claim 18, wherein said first and second remote ends of said first and second legs are pointed.

28. The boutonniere buttoneer as claimed in claim 18, wherein said first and second legs extend less than ½ inch from said back side of said rectangular body.

* * * * *